US008982016B2

(12) United States Patent
Yamashita et al.

(10) Patent No.: US 8,982,016 B2
(45) Date of Patent: Mar. 17, 2015

(54) DISPLAY DEVICE, DRIVING METHOD THEREOF, AND ELECTRONIC DEVICE

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1666 days.

(21) Appl. No.: 12/149,596

(22) Filed: May 5, 2008

(65) Prior Publication Data

US 2008/0291138 A1 Nov. 27, 2008

(30) Foreign Application Priority Data

May 21, 2007 (JP) ..... 2007-134797

(51) Int. Cl.
*G09G 3/30* (2006.01)
*G09G 3/32* (2006.01)

(52) U.S. Cl.
CPC ..... *G09G 3/3233* (2013.01); *G09G 3/3291* (2013.01); *G09G 2300/0819* (2013.01); *G09G 2300/0842* (2013.01); *G09G 2300/0852* (2013.01); *G09G 2300/0861* (2013.01); *G09G 2300/0866* (2013.01); *G09G 2320/043* (2013.01)
USPC ..... 345/76

(58) Field of Classification Search
USPC ..... 345/76–82
See application file for complete search history.

(56) References Cited

U.S. PATENT DOCUMENTS

2004/0207614 A1* 10/2004 Yamashita et al. ..... 345/211
2005/0083270 A1* 4/2005 Miyazawa ..... 345/76
2006/0170628 A1* 8/2006 Yamashita et al. ..... 345/76
2006/0208979 A1* 9/2006 Fish et al. ..... 345/81
2007/0040769 A1* 2/2007 Tai et al. ..... 345/76

FOREIGN PATENT DOCUMENTS

JP 2003-255856 A 9/2003
JP 2003-271095 9/2003
JP 2004-029791 A 1/2004
JP 2004-093682 A 3/2004
JP 2004-133240 A 4/2004
JP 2005-092188 A 4/2005
JP 2005-266309 A 9/2005
JP 2006-215213 8/2006

OTHER PUBLICATIONS

Japanese Office Action issued Jan. 10, 2012 for corresponding Japanese Application No. 2007-134797.

* cited by examiner

*Primary Examiner* — Dennis Joseph
(74) *Attorney, Agent, or Firm* — Rader, Fishman & Grauer PLLC

(57) ABSTRACT

Disclosed herein is a display device including: a pixel array unit; and a driving unit; wherein the pixel array unit includes first scanning lines and second scanning lines in a form of rows, signal lines in a form of columns, and pixels in a form of a matrix, the pixels being disposed at parts where the first scanning lines and the signal lines intersect each other, each pixel includes a drive transistor of an N-channel type, a sampling transistor, a switching transistor, a retaining capacitance, and a light emitting element, the driving unit includes a write scanner for sequentially supplying a control signal to each first scanning line, a drive scanner for sequentially supplying a control signal to each second scanning line, and a signal selector for alternately supplying a signal potential as a video signal and a predetermined reference potential to each signal line.

16 Claims, 13 Drawing Sheets

PREVIOUS DEVELOPMENT

PREVIOUS DEVELOPMENT

PREVIOUS DEVELOPMENT

PREVIOUS DEVELOPMENT

PREVIOUS DEVELOPMENT

DISPLAY DEVICE, DRIVING METHOD THEREOF, AND ELECTRONIC DEVICE

CROSS REFERENCES TO RELATED APPLICATIONS

The present invention contains subject matter related to Japanese Patent Application JP 2007-134797 filed in the Japan Patent Office on May 21, 2007, the entire contents of which being incorporated herein by reference.

BACKGROUND OF THE INVENTION

1. Field of the Invention

The present invention relates to an active matrix type display device using a light emitting element in a pixel, a driving method thereof, and an electronic device including this kind of display device.

2. Description of the Related Art

A display device, for example, a liquid crystal display has a large number of liquid crystal pixels arranged in the form of a matrix, and displays an image by controlling the transmission intensity or reflection intensity of incident light in each pixel according to image information to be displayed. This is true for an organic EL display or the like using an organic EL element in a pixel. However, unlike the liquid crystal pixel, the organic EL element is a self-luminous element. The organic EL display has advantages of high image visibility, no need for a backlight, high response speed and the like as compared with the liquid crystal display. In addition, the luminance level (gradation) of each light emitting element can be controlled by the value of a current flowing through the light emitting element. The organic EL display differs greatly from a voltage control type such as the liquid crystal display or the like in that the organic EL display is of a so-called current control type.

As with the liquid crystal display, there are a simple matrix system and an active matrix system as driving systems of the organic EL display. The former system offers a simple structure, but presents, for example, a problem of difficulty in realizing a large and high-definition display. Therefore, the active matrix system is now being actively developed. This system controls a current flowing through a light emitting element within each pixel circuit by an active element (typically a thin-film transistor (TFT)) provided within the pixel circuit. The active matrix system is described in Japanese Patent Laid-Open No. 2003-255856, Japanese Patent Laid-Open No. 2003-271095, Japanese Patent Laid-Open No. 2004-133240, Japanese Patent Laid-Open No. 2004-029791, Japanese Patent Laid-Open No. 2004-093682 and Japanese Patent Laid-Open No. 2006-215213.

SUMMARY OF THE INVENTION

Pixel circuits in the past are disposed at respective parts where scanning lines in the form of rows which scanning lines supply a control signal and signal lines in the form of columns which signal lines supply a video signal intersect each other. Each of the pixel circuits in the past includes at least a sampling transistor, a retaining capacitance, a drive transistor, and a light emitting element. The sampling transistor conducts according to a control signal supplied from a scanning line to sample a video signal supplied from a signal line. The retaining capacitance retains an input voltage corresponding to the signal potential of the sampled video signal. The drive transistor supplies an output current as a driving current during a predetermined emission period according to the input voltage retained by the retaining capacitance. Incidentally, the output current generally has dependence on the carrier mobility of a channel region in the drive transistor and the threshold voltage of the drive transistor. The light emitting element emits light at a luminance corresponding to the video signal on the basis of the output current supplied from the drive transistor.

The drive transistor receives the input voltage retained by the retaining capacitance at the gate of the drive transistor, makes the output current flow between the source and the drain of the drive transistor, and thus passes the current through the light emitting element. The luminance of the light emitting element is generally proportional to the amount of the current passed through the light emitting element. Further, the amount of the output current supplied by the drive transistor is controlled by a gate voltage, that is, the input voltage written to the retaining capacitance. The pixel circuit in the past controls the amount of current supplied to the light emitting element by changing the input voltage applied to the gate of the drive transistor according to the input video signal.

The operation characteristic of the drive transistor is expressed by the following Equation 1:

$$Ids=(1/2)\mu(W/L)Cox(Vgs-Vth)^2 \qquad \text{Equation 1}$$

In this Transistor Characteristic Equation 1, Ids denotes a drain current flowing between the source and the drain, and is the output current supplied to the light emitting element in the pixel circuit. Vgs denotes a gate voltage applied to the gate with the source as a reference, and is the above-described input voltage in the pixel circuit. Vth denotes the threshold voltage of the transistor. μ denotes the mobility of a semiconductor thin film forming a channel in the transistor. W denotes a channel width. L denotes a channel length. Cox denotes a gate capacitance. As is clear from this Transistor Characteristic Equation 1, when the thin-film transistor operates in a saturation region and the gate voltage Vgs becomes higher than the threshold voltage Vth, the thin-film transistor is brought into an on state, and thus the drain current Ids flows. In theory, as indicated by the above Transistor Characteristic Equation 1, when the gate voltage Vgs is constant, the same amount of drain current Ids is always supplied to the light emitting element. Thus, when video signals all having the same level are supplied to respective pixels forming a screen, all the pixels should emit light at the same luminance, so that uniformity of the screen can be obtained.

In practice, however, individual device characteristics of thin film transistors (TFTS) formed with a semiconductor thin film of polysilicon or the like are varied. The threshold voltage Vth, in particular, is not constant, but is varied in each pixel. As is clear from the above-described Transistor Characteristic Equation 1, when the threshold voltage Vth of each drive transistor is varied, even when the gate voltage Vgs is constant, the drain current Ids is varied and luminance is varied in each pixel, thus impairing the uniformity of the screen. A pixel circuit incorporating a function of cancelling a variation in the threshold voltage of the drive transistor has been developed in the past, and is disclosed in the above-mentioned Japanese Patent Laid-Open No. 2004-133240, for example.

However, the threshold voltage Vth of the drive transistor is not the only factor in variations in the output current supplied to the light emitting element. As is clear from the above-described Transistor Characteristic Equation 1, the output current Ids changes also when the mobility μ of the drive transistor varies. As a result, the uniformity of the screen is impaired. A pixel circuit incorporating a function of cancelling a variation in the mobility of the drive transistor has been developed in the past, and is disclosed in the above-mentioned Japanese Patent Laid-Open No. 2006-215213, for example.

The pixel circuits in the past demand a transistor other than the drive transistor to be formed within the pixel circuits in order to implement the threshold voltage correcting function and the mobility correcting function described above. For higher definition of pixels, it is better to minimize the number of transistor elements forming a pixel circuit. When the number of transistor elements is limited to two, that is, a drive transistor and a sampling transistor for sampling a video signal, for example, power supply voltage supplied to pixels needs to be pulsed in order to implement the threshold voltage correcting function and the mobility correcting function described above.

In this case, a power supply scanner is demanded to apply pulsed power supply voltage (power supply pulse) to each pixel sequentially. For the power supply scanner to supply driving current to each pixel stably, an output buffer of the power supply scanner needs to be of a large size. The power supply scanner therefore demands a large area. When the power supply scanner is formed integrally with a pixel array unit on a panel, the layout area of the power supply scanner is large, and thus limits the effective screen size of the display device. In addition, because the power supply scanner continues supplying the driving current to each pixel during most of the time of line-sequential scanning, transistor characteristics of the output buffer are degraded sharply, and thus reliability in long-term use may not be obtained.

In view of problems of the existing techniques described above, it is desirable to provide a display device that makes it possible to fix power supply voltage while retaining the threshold voltage correcting function and the mobility correcting function of pixels. According to an embodiment of the present invention, there is provided a display device including: a pixel array unit; and a driving unit; wherein the pixel array unit includes first scanning lines and second scanning lines in a form of rows, signal lines in a form of columns, and pixels in a form of a matrix, the pixels being disposed at parts where the first scanning lines and the signal lines intersect each other, each pixel includes a drive transistor of an N-channel type, a sampling transistor, a switching transistor, a retaining capacitance, and a light emitting element, the drive transistor has a gate, a source and a drain connected to a power supply line, the retaining capacitance is connected between the gate and the source of the drive transistor, a gate of the sampling transistor is connected to a first scanning line, and a source and a drain of the sampling transistor are connected between a signal line and the gate of the drive transistor, a gate of the switching transistor is connected to a second scanning line and a drain of the switching transistor is connected to the source of the drive transistor, the light emitting element is connected between the source of the switching transistor and a grounding line, the driving unit includes a write scanner for sequentially supplying a control signal to each first scanning line, a drive scanner for sequentially supplying a control signal to each second scanning line, and a signal selector for alternately supplying a signal potential as a video signal and a predetermined reference potential to each signal line, the write scanner and drive scanner output the control signals to the first and second scanning lines, respectively, to drive the pixel when the signal line is at the reference potential and perform an operation of correcting for threshold voltage of the drive transistor, the write scanner outputs the control signal to the first scanning line to drive the pixel when the signal line is at the signal potential and performs a writing operation of writing the signal potential to the retaining capacitance, and the drive scanner outputs the control signal to the second scanning line to send current through the pixel after the signal potential is written to the retaining capacitance and performs a light emitting operation of the light emitting element.

Preferably, when the signal line is at the signal potential, the write scanner outputs the control signal to the first scanning line to turn on the sampling transistor, whereby the signal potential is written to the retaining capacitance, and meanwhile the switching transistor is in an off state, whereby the source of the drive transistor is electrically disconnected from the light emitting element. An auxiliary capacitance is connected between the source of the drive transistor and a fixed potential. When the signal potential is written to the retaining capacitance, a current flowing from the drain to the source of the drive transistor is negatively fed back to the retaining capacitance, whereby a correction for mobility of the drive transistor is applied to the retained signal potential. When the operation of correcting for the threshold voltage of the drive transistor is performed, the write scanner outputs the control signal to the first scanning line to turn on the sampling transistor, whereby the reference potential from the signal line is sampled, and the gate of the drive transistor is reset to the reference potential, while the drive scanner outputs the control signal to the second scanning line to turn on the switching transistor, whereby a potential of the source of the drive transistor is reset.

According to the above-described embodiment of the present invention, each pixel includes an N-channel type drive transistor, a sampling transistor, a switching transistor, a retaining capacitance, and a light emitting element. In addition to the drive transistor and the sampling transistor as basic components of the pixel, the switching transistor is inserted between the drive transistor and the light emitting element. By thus adding the switching transistor, power supply voltage supplied to the pixel does not have to be pulsed, and the power supply voltage of the pixel can be fixed. This obviates a need for the power supply scanner that has been demanded in the past, and makes it possible to use an ordinary scanner in place of the power supply scanner. Thus, layout area is saved, and a screen can occupy a large proportion on a panel. In addition, line-sequential driving of the pixel array unit can be performed with an ordinary scanner without demanding the power supply scanner having a short life, so that the life of the display device is lengthened. However, while the present invention uses an N-channel type transistor as the drive transistor, not all the transistors forming the pixel need to be of the N-channel type, and either an N-channel type transistor or a P-channel type transistor can be used as the sampling transistor and the switching transistor.

DETAILED DESCRIPTION OF THE PREFERRED EMBODIMENTS

Figure 1:
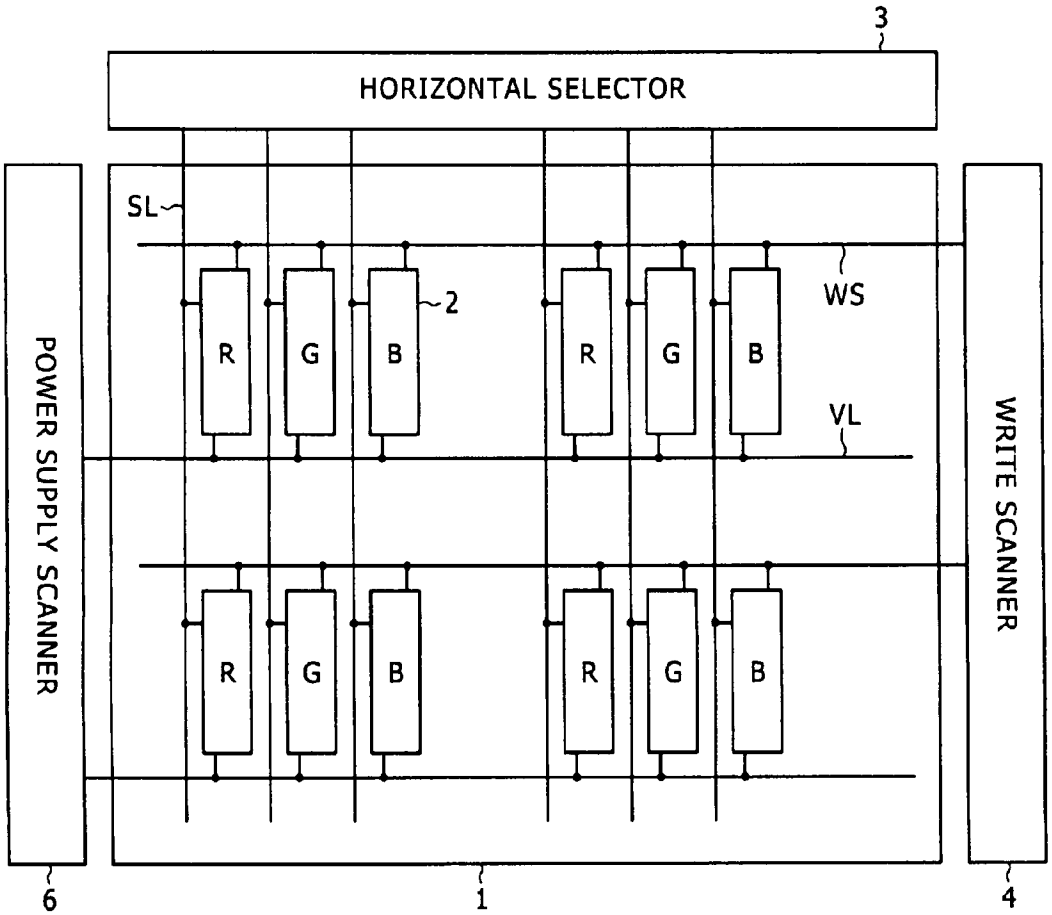
FIG. 1 is a block diagram showing a general configuration of a display device according to an example of the previous development.

Preferred embodiments of the present invention will hereinafter be described in detail with reference to the drawings. Prior to the description, in order to facilitate understanding of the present invention and clarify the background of the present invention, a display device according to a previous development will be described as a reference example. FIG. 1 is a block diagram showing a general configuration of the display device according to the present reference example. As shown in FIG. 1, the display device includes a pixel array unit 1 and a driving unit for driving the pixel array unit 1. The pixel array unit 1 includes scanning lines WS in the form of rows, signal lines SL in the form of columns, pixels 2 in the form of a matrix which pixels are disposed at parts where the scanning lines WS and the signal lines SL intersect each other, and feeder lines (power supply lines) VL arranged in correspondence with each of rows of the pixels 2. Incidentally, in the present example, one of three RGB primary colors is assigned to each of the pixels 2, thus enabling color display. However, the display device is not limited to this, and includes a monochrome display device. The driving unit includes: a write scanner 4 for performing line-sequential driving of the pixels 2 in row units by sequentially supplying a control signal to the respective scanning lines WS; a power supply scanner 6 for supplying a power supply voltage changing between a first potential and a second potential to each feeder line according to the line-sequential driving; and a signal selector (horizontal selector) 3 for supplying a signal potential as a driving signal and a reference potential to the signal lines SL in the form of columns according to the line-sequential driving.

Figure 2:
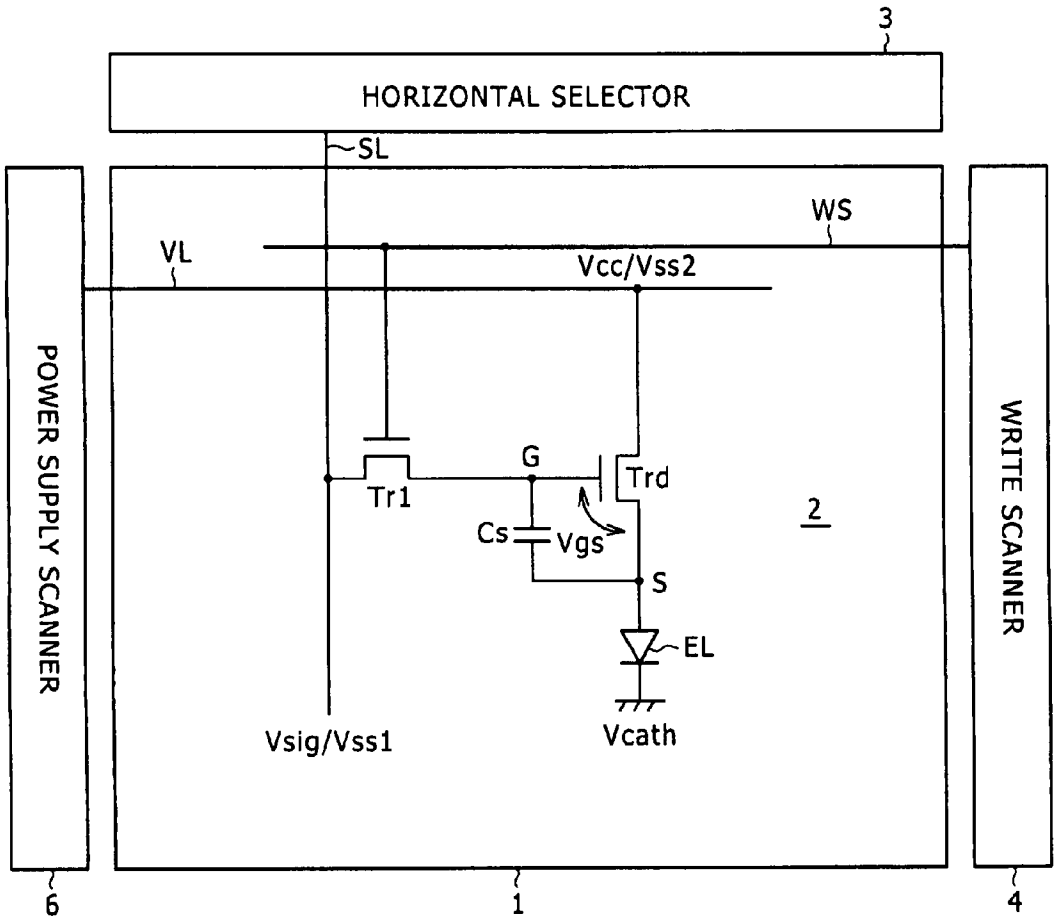
FIG. 2 is a circuit diagram showing a concrete configuration of the display device shown in FIG. 1.

FIG. 2 is a circuit diagram showing a concrete configuration and connection relation of a pixel 2 included in the display device according to the previous development shown in FIG. 1. As shown in FIG. 1, the pixel 2 includes a light emitting element EL typified by an organic EL device or the like, a sampling transistor Tr1, a drive transistor Trd, and a retaining capacitance Cs. The control terminal (gate) of the sampling transistor Tr1 is connected to the corresponding scanning line WS, one of the pair of current terminals (source and drain) of the sampling transistor Tr1 is connected to the corresponding signal line SL, and the other of the pair of current terminals of the sampling transistor Tr1 is connected to the control terminal (gate G) of the drive transistor Trd. One of the pair of current terminals (source S and drain) of the drive transistor Trd is connected to the light emitting element EL, and the other of the pair of current terminals of the drive transistor Trd is connected to the corresponding feeder line VL. In the present example, the drive transistor Trd is of the N-channel type. The drain of the drive transistor Trd is connected to the feeder line VL, while the source S of the drive transistor Trd is connected as an output node to the anode of the light emitting element EL. The cathode of the light emitting element EL is connected to a predetermined cathode potential Vcath. The retaining capacitance Cs is connected between the source S as one current terminal of the drive transistor Trd and the gate G as control terminal of the drive transistor Trd.

In such a configuration, the sampling transistor Tr1 conducts according to a control signal supplied from the scanning line WS to sample a signal potential supplied from the signal line SL and retain the signal potential in the retaining capacitance Cs. The drive transistor Trd is supplied with a current from the feeder line VL at the first potential (high potential Vcc), and passes a driving current through the light emitting element EL according to the signal potential retained in the retaining capacitance Cs. In order to set the sampling transistor Tr1 in a conducting state in a time period in which the signal line SL is at the signal potential, the write scanner 4 outputs the control signal of a predetermined pulse width to the scanning line WS, whereby the signal potential is retained in the retaining capacitance Cs, and a correction for the mobility μ of the drive transistor Trd is made to the signal potential at the same time. Thereafter the drive transistor Trd supplies the light emitting element EL with the driving current according to the signal potential Vsig written to the retaining capacitance Cs. A light emitting operation thus begins.

The pixel 2 has a threshold voltage correcting function as well as the above-described mobility correcting function. Specifically, the power supply scanner 6 changes the feeder line VL from the first potential (high potential Vcc) to the second potential (low potential Vss2) in first timing before the sampling transistor Tr1 samples the signal potential Vsig. In addition, the write scanner 4 makes the sampling transistor Tr1 conduct to apply a reference potential Vss1 from the signal line SL to the gate G of the drive transistor Trd in second timing before the sampling transistor Tr1 samples the signal potential Vsig, and the source S of the drive transistor Trd is set to the second potential (Vss2). In third timing after the second timing, the power supply scanner 6 changes the feeder line VL from the second potential Vss2 to the first potential Vcc to retain a voltage corresponding to the threshold voltage Vth of the drive transistor Trd in the retaining capacitance Cs. By such a threshold voltage correcting function, the display device can cancel the effect of the threshold voltage vth of the drive transistor Trd which threshold voltage varies in each pixel.

The pixel 2 also has a bootstrap function.

Specifically, the write scanner 4 cancels the application of the control signal to the scanning line WS in a stage in which the signal potential Vsig is retained in the retaining capacitance Cs, so that the sampling transistor Tr1 is set in a non-conducting state to electrically disconnect the gate G of the drive transistor Trd from the signal line SL. Thereby, the potential of the gate G of the drive transistor Trd is interlocked with variation in potential of the source S of the drive transistor Trd, and thus a voltage Vgs between the gate G and the source S can be held constant.

Figure 3:
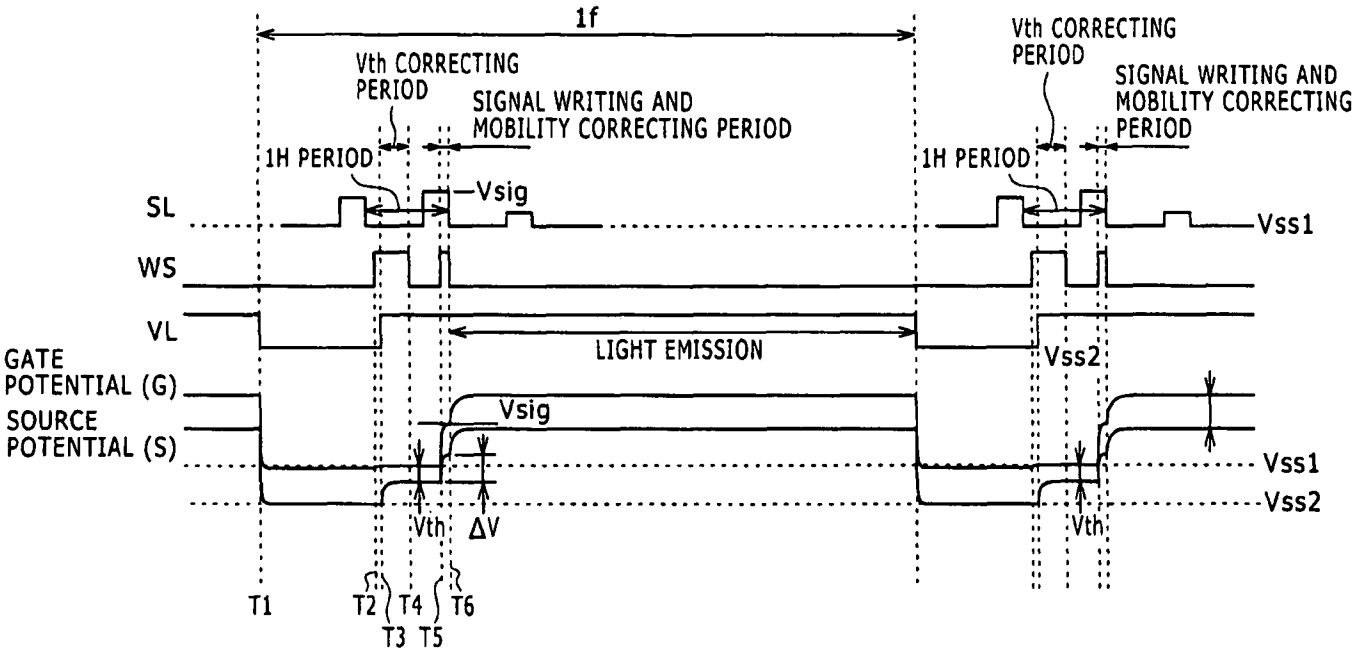
FIG. 3 is a timing chart of assistance in explaining operation of the display device shown in FIG. 2.

FIG. 3 is a timing chart of assistance in explaining the operation of the pixel 2 according to the previous development shown in FIG. 2. FIG. 3 shows changes in potential of the scanning line WS, changes in potential of the feeder line VL, and changes in potential of the signal line SL along a common time axis. In parallel with these potential changes, changes in potential of the gate G and the source S of the drive transistor are also shown.

A control signal pulse for turning on the sampling transistor Tr1 is applied to the scanning line WS. This control signal pulse is applied to the scanning line WS in a cycle of one field (1*f*) according to the line-sequential driving of the pixel array unit. This control signal pulse includes two pulses during one horizontal scanning period (1H). The first pulse may be referred to as a first pulse P1, and the subsequent pulse may be referred to as a second pulse P2. The feeder line VL changes between the high potential Vcc and the low potential Vss2 in the same cycle of one field (1*f*). The signal line SL is supplied with a driving signal changing between the signal potential Vsig and the reference potential Vss1 within one horizontal scanning period (1H).

As shown in the timing chart of FIG. 3, the pixel enters the non-emission period of a field in question from the emission period of a previous field, and thereafter the emission period of the field in question begins. During the non-emission period, preparatory operation, threshold voltage correcting operation, signal writing operation, mobility correcting operation and the like are performed.

During the emission period of the previous field, the feeder line VL is at the high potential Vcc, and the drive transistor Trd supplies a driving current Ids to the light emitting element EL. The driving current Ids passes from the feeder line VL through the light emitting element EL via the drive transistor Trd, and then flows into a cathode line.

Next, when the non-emission period of the field in question begins, the feeder line VL is changed from the high potential Vcc to the low potential Vss2 in first timing T1. Thereby, the feeder line VL is discharged to the low potential Vss2, and the potential of the source S of the drive transistor Trd drops to the low potential Vss2. The anode potential of the light emitting element EL (that is, the source potential of the drive transistor Trd) is thus set in a reverse bias state, so that the driving current stops flowing and the light emitting element EL is turned off. The potential of the gate G of the drive transistor also drops in such a manner as to be interlocked with the drop in potential of the source S of the drive transistor.

In next timing T2, the scanning line WS is changed from a low level to a high level to thereby set the sampling transistor Tr1 in a conducting state. At this time, the signal line SL is at the reference potential Vss1. Thus, the potential of the gate G of the drive transistor Trd becomes the reference potential Vss1 of the signal line SL through the conducting sampling transistor Tr1. The potential of the source S of the drive transistor Trd at this time is the potential Vss2, which is sufficiently lower than the reference potential Vss1. The voltage Vgs between the gate G and the source S of the drive transistor Trd is thus initialized so as to be larger than the threshold voltage Vth of the drive transistor Trd. A period T1 to T3 from timing T1 to timing T3 is a preparatory period for setting the voltage Vgs between the gate G and the source S of the drive transistor Trd equal to or larger than the threshold voltage Vth in advance.

Thereafter, in timing T3, the feeder line VL makes a transition from the low potential Vss2 to the high potential Vcc, and the potential of the source S of the drive transistor Trd starts rising. After a while, current cuts off when the voltage Vgs between the gate G and the source S of the drive transistor Trd becomes the threshold voltage Vth. Thus, a voltage corresponding to the threshold voltage Vth of the drive transistor Trd is written to the retaining capacitance Cs. This is the threshold voltage correcting operation. At this time, in order for the current to flow only to the retaining capacitance Cs side and not to flow through the light emitting element EL, a cathode potential Vcath is set such that the light emitting element EL cuts off.

In timing T4, the scanning line WS returns from the high level to the low level. In other words, the first pulse P1 applied to the scanning line WS is cancelled, so that the sampling transistor is set in an off state. As is clear from the above description, the first pulse P1 is applied to the gate of the sampling transistor Tr1 to perform the threshold voltage correcting operation.

Thereafter the signal line SL changes from the reference potential Vss1 to the signal potential Vsig. Next, in timing T5, the scanning line WS rises from the low level to the high level again. In other words, the second pulse P2 is applied to the gate of the sampling transistor Tr1. Thereby the sampling transistor Tr1 is turned on again to sample the signal potential Vsig from the signal line SL. The potential of the gate G of the drive transistor Trd therefore becomes the signal potential Vsig. In this case, because the light emitting element EL is first in a cutoff state (high-impedance state), the current flowing between the drain and the source of the drive transistor Trd entirely flows into the retaining capacitance Cs and an equivalent capacitance of the light emitting element EL, and starts a charge. Thereafter the potential of the source S of the drive transistor Trd rises by ΔV before timing T6 in which timing the sampling transistor Tr1 is turned off. Thus, the signal potential Vsig of a video signal is written to the retaining capacitance Cs in a form of being added to the threshold voltage Vth, and the voltage ΔV for mobility correction is subtracted from the voltage retained in the retaining capacitance Cs. Hence, a period T5 to T6 from timing T5 to timing T6 is a signal writing period and mobility correcting period. In other words, signal writing operation and mobility correcting operation is performed when the second pulse P2 is applied to the scanning line WS. The signal writing period and mobility correcting period T5 to T6 is equal to the pulse width of the second pulse P2. That is, the pulse width of the second pulse P2 defines the mobility correcting period.

Thus, the writing of the signal potential Vsig and the adjustment of the amount of correction ΔV are performed simultaneously during the signal writing period T5 to T6. The higher the signal potential Vsig, the larger the current Ids supplied by the drive transistor Trd, and the higher the absolute value of the amount of correction ΔV. Hence, a mobility correction is made according to the level of light emission luminance. When the signal potential Vsig is fixed, the higher the mobility μ of the drive transistor Trd, the higher the absolute value of the amount of correction ΔV. In other words, the higher the mobility μ, the larger the amount of negative feedback ΔV to the retaining capacitance Cs. Therefore, variations in mobility μ of each pixel can be removed.

Figure 4:
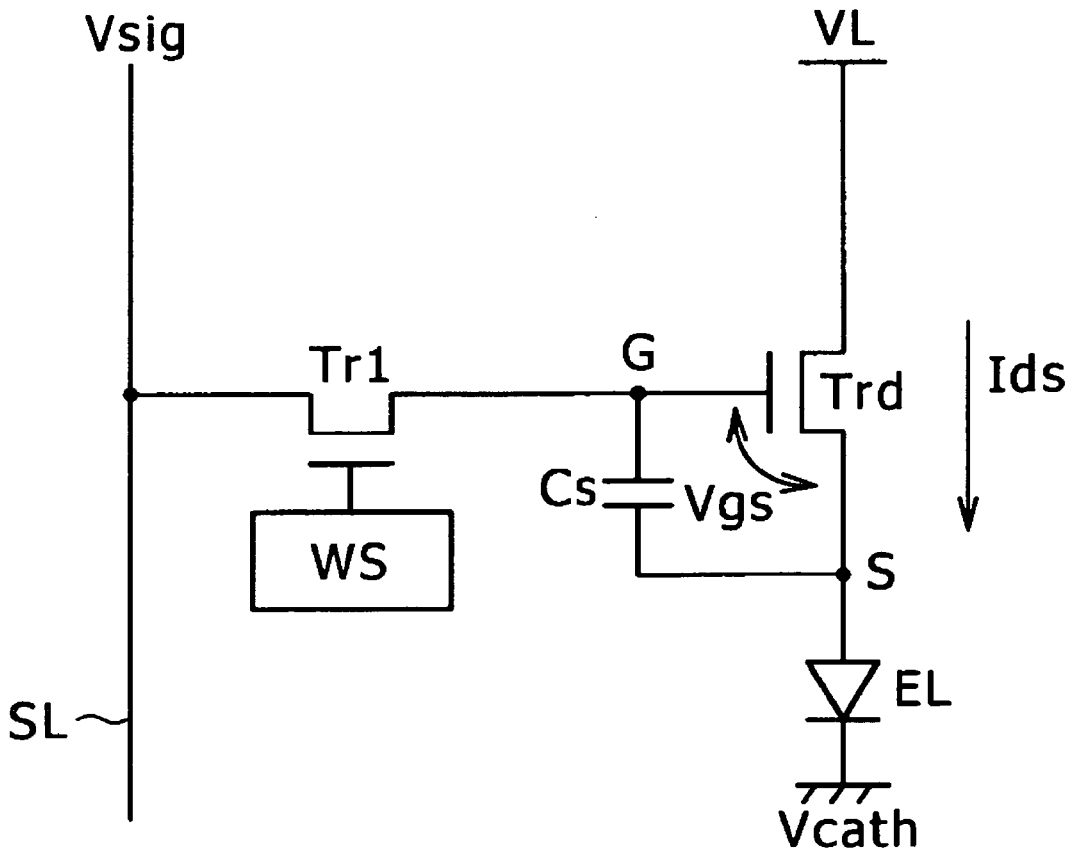
FIG. 4 is a schematic diagram of assistance in explaining the operation of the display device shown in FIG. 2.

Finally, in timing T6, the scanning line WS changes to the low level side as described above to set the sampling transistor Tr1 in an off state. This state is schematically shown in FIG. 4. The gate G of the drive transistor Trd is thereby disconnected from the signal line SL. At this time, a drain current Ids starts to flow through the light emitting element EL as shown in FIG. 4. The anode potential of the light emitting element EL thereby rises according to the driving current Ids. The rise in the anode potential of the light emitting element EL is none other than a rise in potential of the source S of the drive transistor Trd. When the potential of the source S of the drive transistor Trd rises, the potential of the gate G of the drive transistor Trd also rises in such a manner as to be interlocked with the potential of the source S of the drive transistor Trd due to the bootstrap operation of the retaining capacitance Cs. The amount of the rise in the gate potential is equal to the amount of the rise in the source potential. Thus the voltage Vgs between the gate G and the source S of the drive transistor Trd is held constant during the emission period. The value of the gate voltage Vgs is a result of correcting the signal potential Vsig for the threshold voltage Vth and the mobility μ. The drive transistor Trd operates in a saturation region. That is, the drive transistor Trd supplies the driving current Ids corresponding to the gate-to-source voltage Vgs. The value of the voltage Vgs is a result of correcting the signal potential Vsig for the threshold voltage Vth and the mobility μ.

Figure 5:
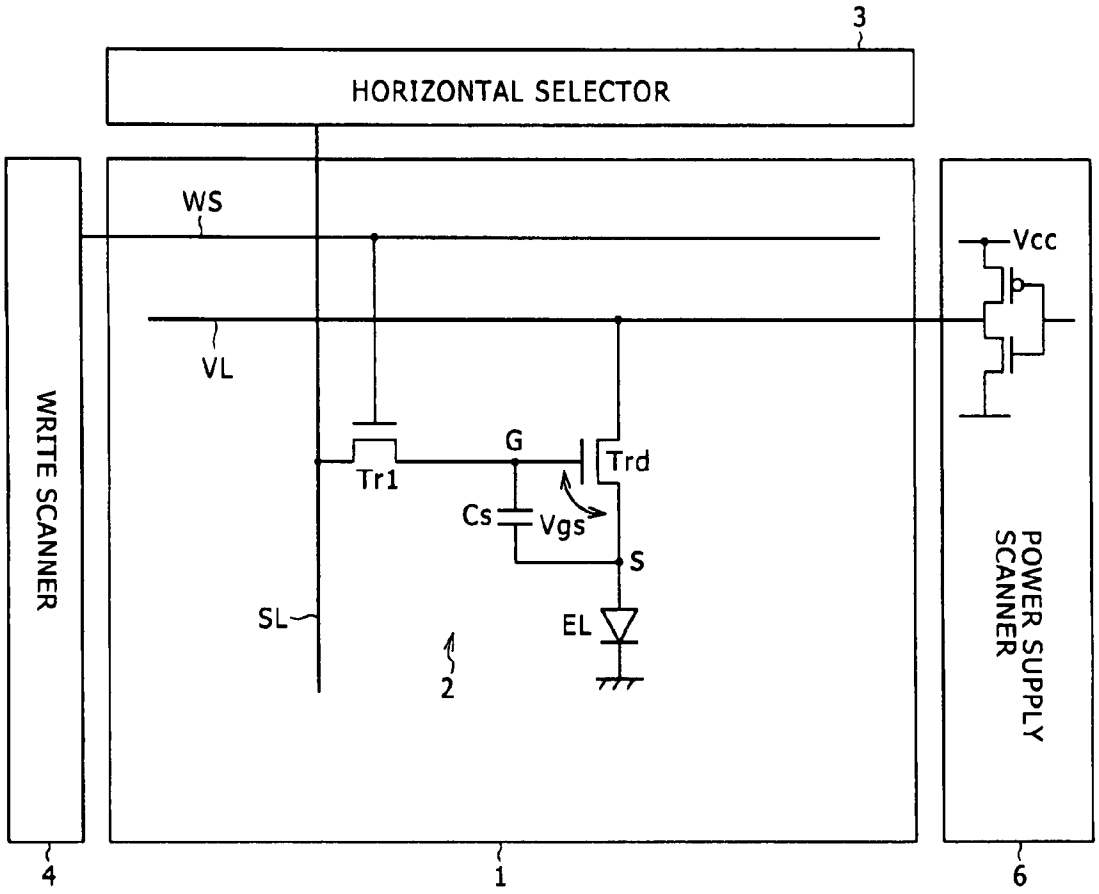
FIG. 5 is a circuit diagram similarly showing the display device according to the example of the previous development.

FIG. 5 is a schematic diagram showing in enlarged dimension the power supply scanner 6 of the display device according to the previous development shown in FIG. 2. As shown in FIG. 2, the power supply scanner 6 has an output buffer formed by an inverter in each stage. The output buffer outputs a power supply pulse to the corresponding feeder line VL. As described above, the display device according to the reference example supplies the power supply line with a pulse. The pulse is supplied as a power supply pulse VL from the power supply scanner 6 to the pixel 2 side. At the time of light emission, a panel power supply is at the high potential Vcc, and thus the P-channel transistor of the buffer in a last stage of the power supply scanner 6 is turned on to supply the power supply voltage to the pixel side. The light emission current of one pixel is a few μA. Because about 1,000 pixels are connected to each other per line (per row) along a horizontal direction, a total output current is a few mA. In order to prevent a voltage drop when the driving current is made to flow, the output buffer of a large size of a few mm needs to be laid out, thus resulting in a large layout area. Further, because the light emission current continues flowing at all times, characteristics of the transistor of the output buffer are degraded sharply, and thus reliability in long-term use may not be obtained.

Figure 6:
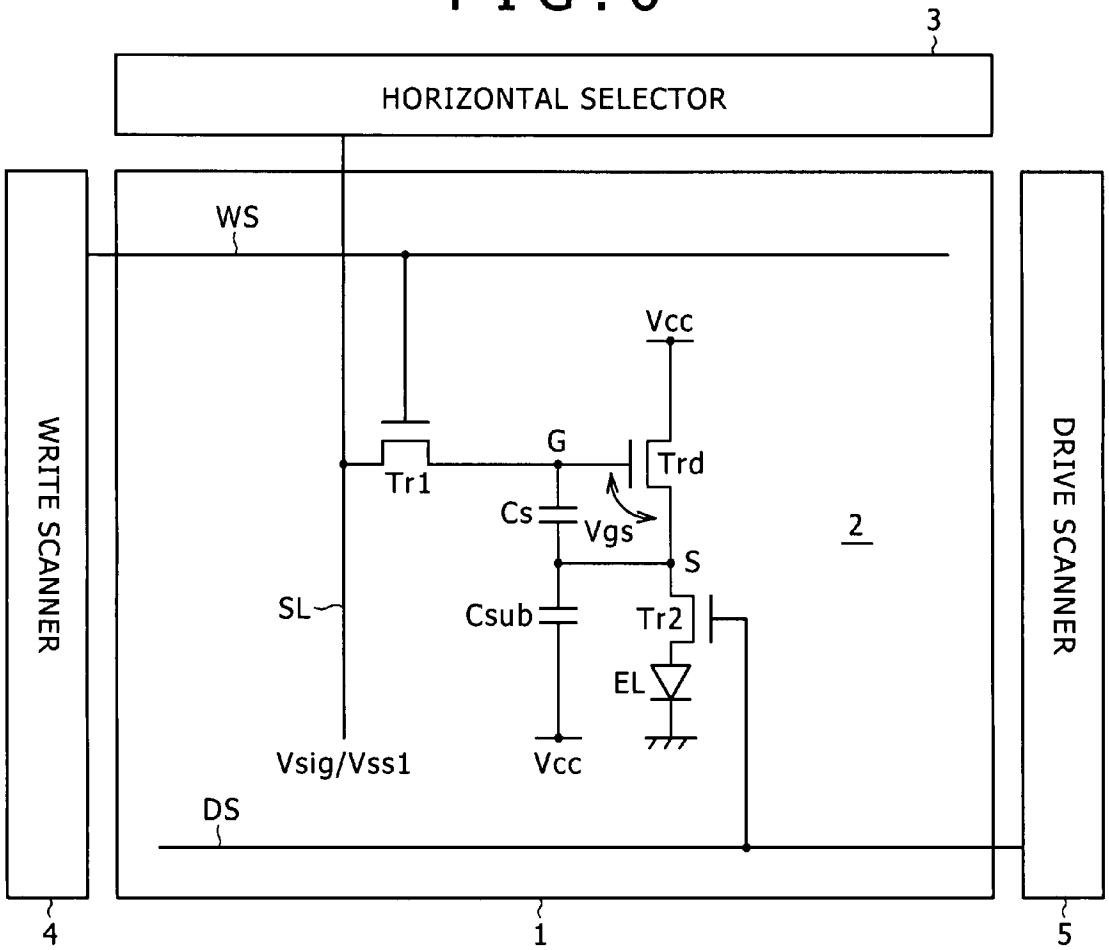
FIG. 6 is a circuit diagram showing a configuration of a display device according to an embodiment of the present invention.

FIG. 6 is a circuit diagram showing a display device according to an embodiment of the present invention. This display device is a result of addressing disadvantages of the display device according to the previous development described above. Basically, an N-channel type transistor is used as a drive transistor, and a switching transistor is inserted between the drive transistor and a light emitting element. Such a constitution makes it possible to fix power supply voltage supplied to a pixel. In addition, the pixel can be disconnected from the power supply voltage during a mobility correcting period.

As shown in FIG. 6, the display device basically includes a pixel array unit 1 and a peripheral driving unit. The pixel array unit 1 includes first scanning lines WS and second scanning lines DS in the form of rows, signal lines SL in the form of columns, and pixels 2 in the form of a matrix which pixels are disposed at parts where the first scanning lines WS and the signal lines SL intersect each other. Each pixel 2 includes an N-channel type drive transistor Trd, an N-channel type sampling transistor Tr1, an N-channel type switching transistor Tr2, a retaining capacitance Cs, and a light emitting element EL. This light emitting element EL is for example an organic electroluminescence element. However, the present invention does not demand that all the transistors forming the pixel be N-channel type transistors, and a P-channel type transistor may be used as the sampling transistor and the switching transistor.

The drive transistor Trd includes a gate G, a source S, and a drain connected to a power supply line Vcc. The retaining capacitance Cs has one terminal thereof connected to the gate G of the drive transistor Trd, and has another terminal thereof connected to the source S of the drive transistor Trd. The other terminal of the retaining capacitance Cs is connected with one terminal of an auxiliary capacitance Csub. Another terminal of the auxiliary capacitance Csub is connected to a fixed potential. In the example shown in FIG. 6, the other terminal of the auxiliary capacitance Csub is connected to a power supply line Vcc. The sampling transistor Tr1 has a gate connected to a first scanning line WS, and has a source and a drain connected between a signal line SL and the gate G of the drive transistor Trd. The switching transistor Tr2 has a gate connected to a second scanning line DS, and has a drain connected to the source S of the drive transistor Trd. The light emitting element EL is of a diode type, and has an anode and a cathode. The anode of the light emitting element EL is connected to the source side of the switching transistor Tr2, and the cathode of the light emitting element EL is connected to a grounding line.

The driving unit includes: the write scanner 4 for sequentially supplying a control signal to the first scanning line WS; the drive scanner 5 for sequentially supplying a control signal to each second scanning line DS; and the signal selector 3 for alternately supplying the signal potential Vsig as the video signal and the predetermined reference potential Vss1 to each signal line SL. Unlike the example of the previous development, the power supply line Vcc is fixed, and the power supply scanner for supplying a power supply pulse is not requisite. The drive scanner 5 which controls the gate of the switching transistor Tr2 is used in place of the power supply scanner. The drive scanner 5 has an ordinary scanner structure similar to that of the write scanner 4, and does not particularly demand a high capacity of an output buffer. Therefore an area occupied by the pixel array unit 1 on a panel is not squeezed.

The write scanner 4 and the drive scanner 5 output control signals WS and DS to the first scanning line WS and the second scanning line DS respectively to drive the pixel 2 when the signal line SL is at the reference potential Vss1, whereby an operation of correcting the threshold voltage Vth of the drive transistor Trd is performed. The write scanner 4 outputs another control signal to the first scanning line WS to drive the pixel 2 when the signal line SL is at the signal potential Vsig, whereby a writing operation of writing the signal potential Vsig to the retaining capacitance Cs is performed. After the signal potential Vsig is written to the retaining capacitance Cs, the drive scanner 5 outputs yet another control signal to the second scanning line DS to pass a current through the pixel 2, so that a light emitting operation of the light emitting element EL is performed.

Preferably, when the signal line SL is at the signal potential Vsig, the write scanner 4 outputs the control signal to the first scanning line WS to turn on the sampling transistor Tr1, whereby the signal potential Vsig is written to the retaining capacitance Cs, and meanwhile the switching transistor Tr2 is in an off state, whereby the source S of the drive transistor Trd is electrically disconnected from the light emitting element EL. When the signal potential Vsig is thus written to the retaining capacitance Cs, a current flowing from the drain to the source S of the drive transistor Trd is negatively fed back to the retaining capacitance Cs, whereby a correction for mobility μ of the drive transistor Trd is applied to the signal potential Vsig retained by the retaining capacitance Cs. When the mobility correction is applied, the pixel 2 side is disconnected from a power supply system.

When an operation of correcting for the threshold voltage Vth of the drive transistor Trd is performed, the write scanner 4 outputs the control signal WS to the first scanning line WS to turn on the sampling transistor Tr1, whereby the reference potential Vss1 from the signal line SL is sampled, and the gate G of the drive transistor Trd is reset to the reference potential Vss1, while the drive scanner 5 outputs the control signal DS to the second scanning line DS to turn on the switching transistor Tr2, whereby the potential of the source S of the drive transistor Trd is reset to a predetermined operating point.

Figure 7:
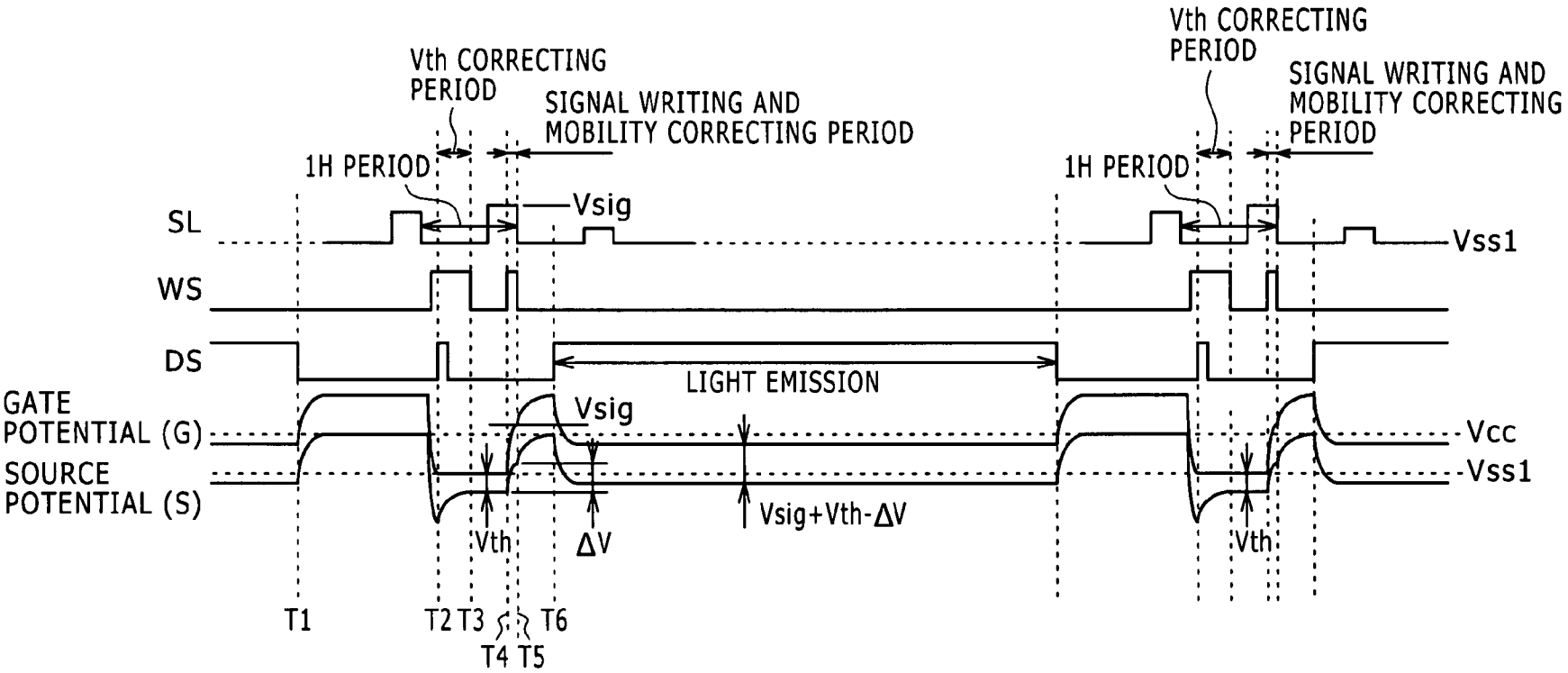
FIG. 7 is a timing chart of assistance in explaining operation of the display device shown in FIG. 6.

FIG. 7 is a timing chart of assistance in explaining the operation of the display device according to the first embodiment of the present invention which display device is shown in FIG. 6. FIG. 7 shows changes in potential of the scanning line WS, changes in potential of the scanning line DS, and changes in potential of the signal line SL along a common time axis T. In parallel with these potential changes, changes in potential of the gate G and the source S of the drive transistor Trd are also shown.

As shown in the timing chart of FIG. 7, the pixel enters the non-emission period of a field in question in timing T1 from the emission period of a previous field, and thereafter the emission period of the field in question begins in timing T6. During the non-emission period from timing T1 to timing T6, preparatory operation, threshold voltage correcting operation, signal writing operation, mobility correcting operation and the like are performed.

When the non-emission period of the field in question begins, the scanning line DS is first changed from a high level to a low level in timing T1, whereby the N-channel type switching transistor Tr2 is turned off. The drive transistor Trd is thereby disconnected from the grounding line side, so that the potential of the source S of the drive transistor Trd rises to close to a power supply voltage Vcc. The potential of the gate G of the drive transistor Trd also shifts upward in such a manner as to be interlocked with the rise in the potential of the source S of the drive transistor Trd.

Thereafter, with the signal line SL at the reference potential Vss1, the scanning line WS is set to a high level to turn on the sampling transistor Tr1. The reference potential Vss1 is thereby written to the gate G of the drive transistor Trd. Then the control signal DS is changed to a high level so that the switching transistor Tr2 is on for a very short period from timing T2. Thereby a current flows from the power supply line Vcc through the drive transistor Trd and the light emitting element EL to the grounding line. At this time, a potential corresponding to a predetermined operating point is written to the source S of the drive transistor Trd. Thus, the gate G and the source S of the drive transistor Trd are reset in timing T2.

After a very short time after timing T2, the control signal DS is cancelled, and thus the switching transistor Tr2 is turned off. Thereafter the current flows until the drive transistor Trd cuts off. At a point in time at which the drive transistor Trd cuts off, a potential difference between the gate G and the source S of the drive transistor Trd becomes Vth. After the passage of a time until the drive transistor Trd cuts off, the control signal WS is changed from the high level to a low level to turn off the sampling transistor Tr1. A period from timing T2 to timing T3 is a threshold voltage correcting period.

Thereafter, for a very short period from timing T4 to timing T5, the scanning line WS is at the high level again and thereby the sampling transistor Tr1 is on. At this time, the signal line SL is at the signal potential Vsig. The signal potential Vsig is thereby written to the gate G of the drive transistor Trd. A part of a current flowing through the drive transistor Trd at this time is negatively fed back to the retaining capacitance Cs, so that a predetermined mobility correcting operation is performed. The amount of this negative feedback is denoted by ΔV in the timing chart of FIG. 7. As is clear from the above description, a period from timing T4 to timing T5 is a signal writing and mobility correcting period.

Finally, in timing T6, the control signal DS is changed from a low level to a high level to turn on the switching transistor Tr2. The drive transistor Trd and the light emitting element EL are thereby connected to each other, a driving current flows, and thus an emission period begins.

Figure 8:
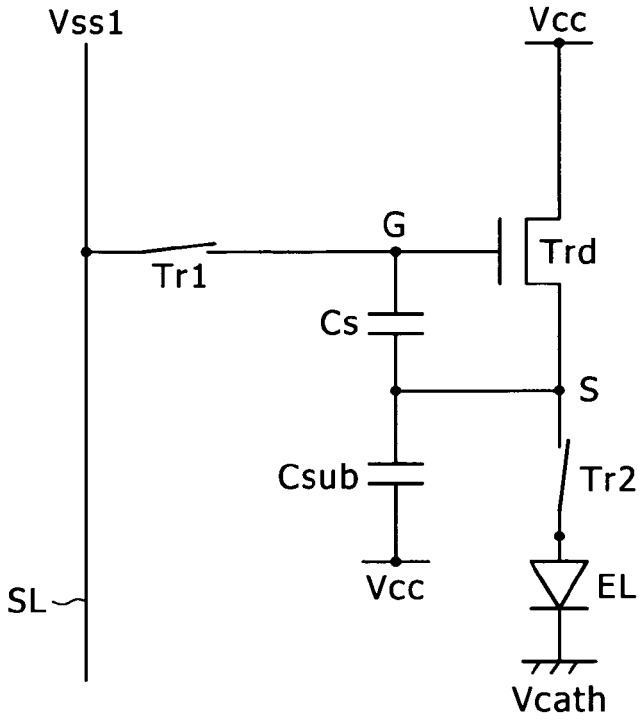
FIG. 8 is a schematic diagram similarly of assistance in explaining the operation of the display device shown in FIG. 6.

The operation of the display device according to the first embodiment of the present invention which display device is shown in FIG. 6 will next be described in detail with reference to FIGS. 8 to 11. FIG. 8 shows a state of operation of the pixel in precisely timing T2. As described above, before timing T2, the sampling transistor Tr1 and the switching transistor Tr2 are both off, and are thus in a non-emission period. In timing T2, the sampling transistor Tr1 is first turned on. At this time, the signal line SL is at the reference potential Vss1. The reference potential Vss1 is therefore written to the gate G of the drive transistor Trd. Immediately after timing T2, the switching transistor Tr2 is also turned on. In this case, the pixel 2 becomes a source follower for the input potential Vss1, and the potential of the source S of the drive transistor Trd is determined by an operating point of the drive transistor Trd and the light emitting element EL. The potentials of the gate G and the source S of the drive transistor Trd are thus reset. At this time, the operating point is set such that the voltage Vgs between the gate G and the source S exceeds the threshold voltage Vth. During the period during which the switching transistor Tr2 is on, a through current flows from the power supply line Vcc to the grounding line Vcath, and the light emitting element EL thus emits light, which causes so-called black floating. Therefore the time during which the switching transistor Tr2 is on needs to be set as short as possible.

Figure 9:
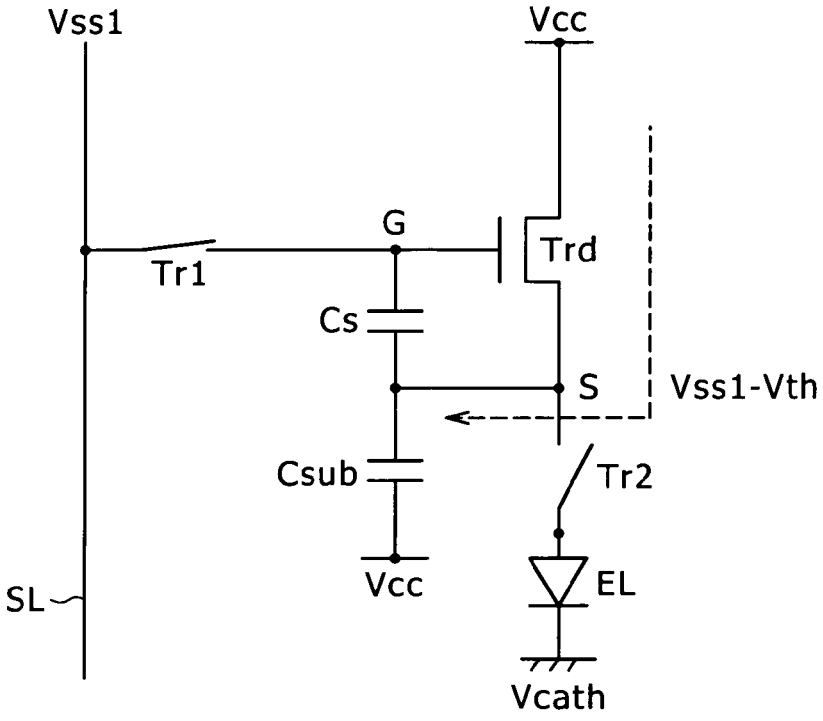
FIG. 9 is a schematic diagram similarly of assistance in explaining the operation.

FIG. 9 shows a state immediately after the switching transistor Tr2 is turned off after the above-described timing T2. At this point in time, the sampling transistor Tr1 is still in an on state, and the gate G of the drive transistor Trd is fixed at the reference potential Vss1. A current therefore flows from the power supply line Vcc to the source S until the drive transistor Trd cuts off. As a result, the potential of the source S of the drive transistor Trd becomes Vss1−Vth. After the potential corresponding to the threshold voltage Vth is thus written to the retaining capacitance Cs, the sampling transistor Tr1 is turned off.

Figure 10:
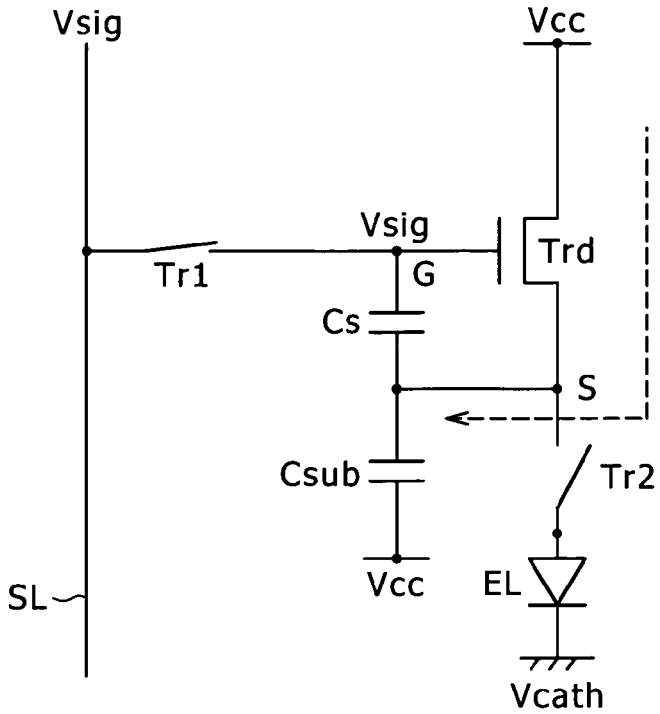
FIG. 10 is a schematic diagram similarly of assistance in explaining the operation.

FIG. 10 schematically shows a state of operation of the pixel in the signal potential writing and mobility correcting period T4 to T5. In this period, after the signal line SL is changed from the reference potential Vss1 to the signal potential Vsig, the sampling transistor Tr1 is turned on for only a relatively short time. In this case, the signal potential Vsig is made lower than the power supply potential Vcc, and set such that the drive transistor Trd is driven in a saturation region. Thereby, the signal potential Vsig is written to the gate G of the drive transistor Trd, while mobility correcting operation is performed according to the signal potential Vsig, so that the potential of the source S of the drive transistor Trd is determined. The mobility correcting period during which the sampling transistor Tr1 is on is set at a few ps or less. When the signal potential writing and mobility correcting operation is completed, the sampling transistor Tr1 is turned off. The drive transistor Trd is on at this time. The potential of the source S of the drive transistor Trd rises to the power supply potential Vcc while the voltage Vgs is maintained.

Figure 11:
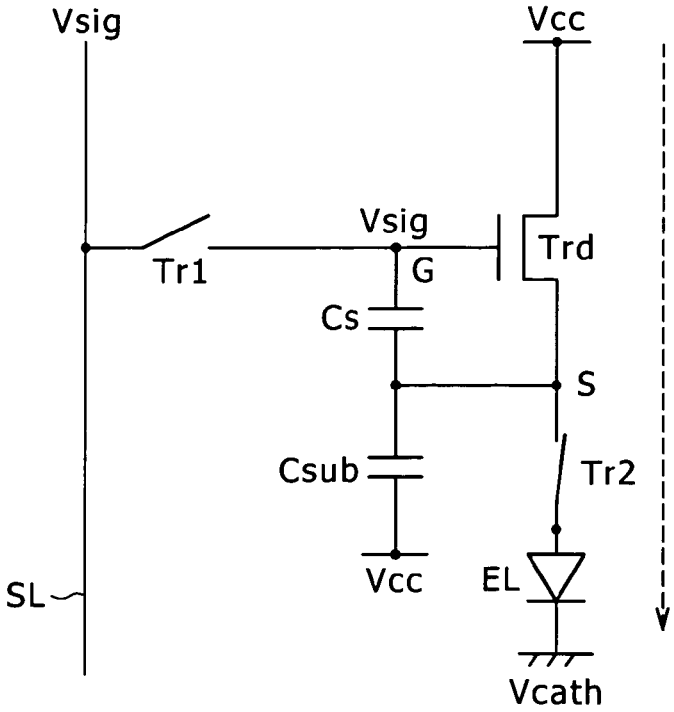
FIG. 11 is a schematic diagram similarly of assistance in explaining the operation.

FIG. 11 shows a state of operation when an emission period begins in timing T6. As shown in FIG. 11, when the switching transistor Tr2 is turned on, the drive transistor Trd and the light emitting element EL are electrically connected to each other. The drive transistor Trd feeds a driving current Ids corresponding to the gate voltage Vgs retained by the retaining capacitance Cs into the light emitting element EL. The anode voltage of the light emitting element EL rises, and then reaches an operating point voltage corresponding to the current. Thereafter steady-state light emitting operation is performed.

As is clear from the above description, by forming the pixel with the switching transistor Tr2 as well as the drive transistor Trd and the sampling transistor Tr1, the power supply voltage Vcc of the pixel can be fixed. Because a power supply scanner as in the example of the previous development is not requisite, an area (screen size) occupied by the pixel array unit on the panel can be made as large as possible, and the life of the scanner side can be lengthened. By fixing the power supply voltage applied to the pixel, a voltage applied between the drain and the source of the drive transistor Trd can be decreased, and the withstand voltage of the drive transistor Trd can be correspondingly lowered. The pixel circuit according to the first embodiment of the present invention, therefore, makes it possible to easily introduce a process for reduced thickness of a gate insulating film or the like. In addition, the switching transistor Tr2 inserted between the source S of the drive transistor Trd and the anode of the light emitting element EL eliminates a need for a negative power supply line Vcath. The threshold voltage correcting operation and the mobility correcting operation can be performed even when the negative power supply line is not provided. In the example of the previous development, when the threshold voltage correcting operation and the mobility correcting operation are performed, the light emitting element EL is set in a reverse-biased state so that current does not flow through the light emitting element EL. The negative power supply Vcath is necessary to set the light emitting element EL in the reverse-biased state, thus complicating circuit configuration. On the other hand, the present invention does not particularly demand that the light emitting element EL be set in the reverse-biased state because the light emitting element EL can be disconnected from the source S of the drive transistor Trd when the threshold voltage correcting operation and the mobility correcting operation are performed.

Figure 12:
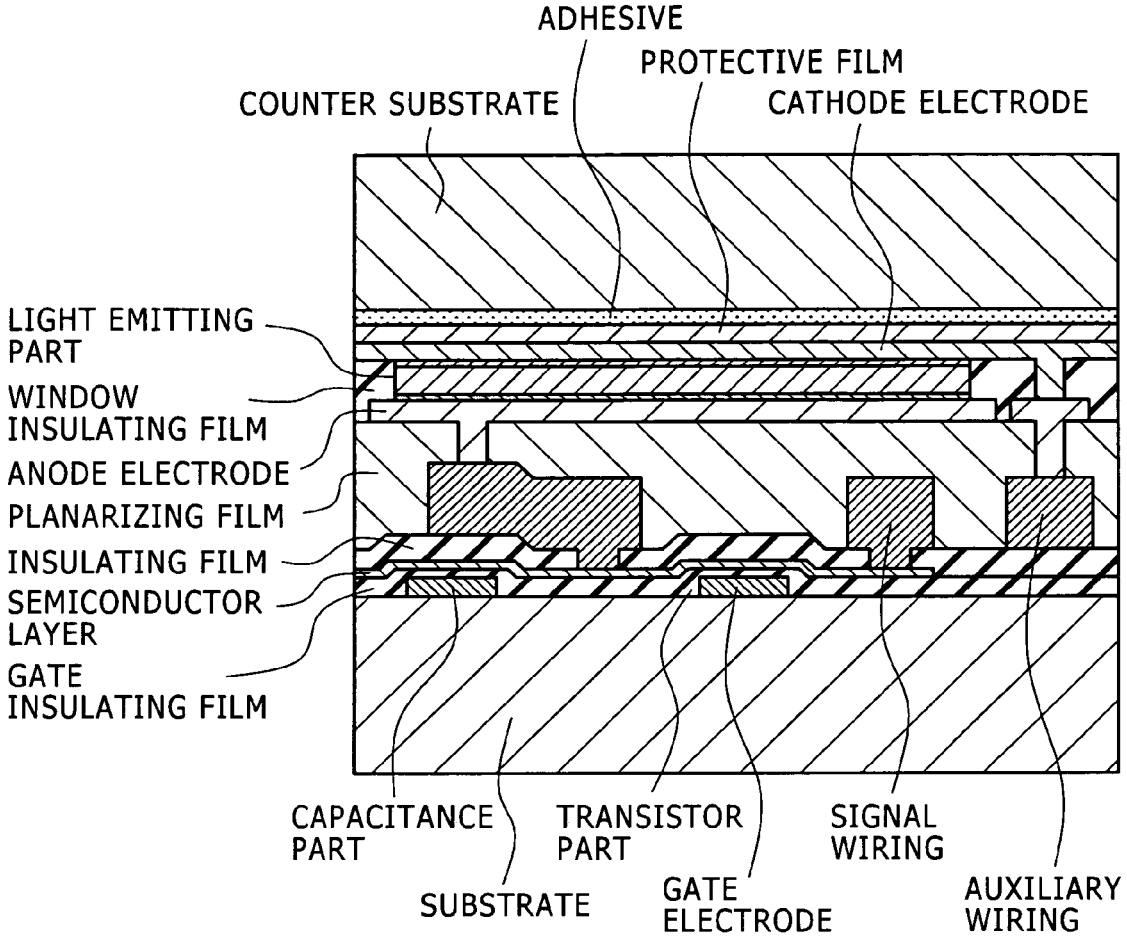
FIG. 12 is a sectional view of a device structure of a display device according to an embodiment of the present invention.

A display device according to an embodiment of the present embodiment has a thin film device structure as shown in FIG. 12. This figure schematically shows a sectional structure of a pixel formed on an insulative substrate. As shown in FIG. 12, the pixel includes a transistor part including a plurality of thin film transistors (one TFT is illustrated in the figure), a capacitance part of a retaining capacitance and the like, and a light emitting part of an organic EL element and the like. The transistor part and the capacitance part are formed on the substrate by a TFT process, and the light emitting part of the organic EL element and the like is stacked on the transistor part and the capacitance part. A transparent counter substrate is attached on the light emitting part via an adhesive to form a flat panel.

Figure 13:
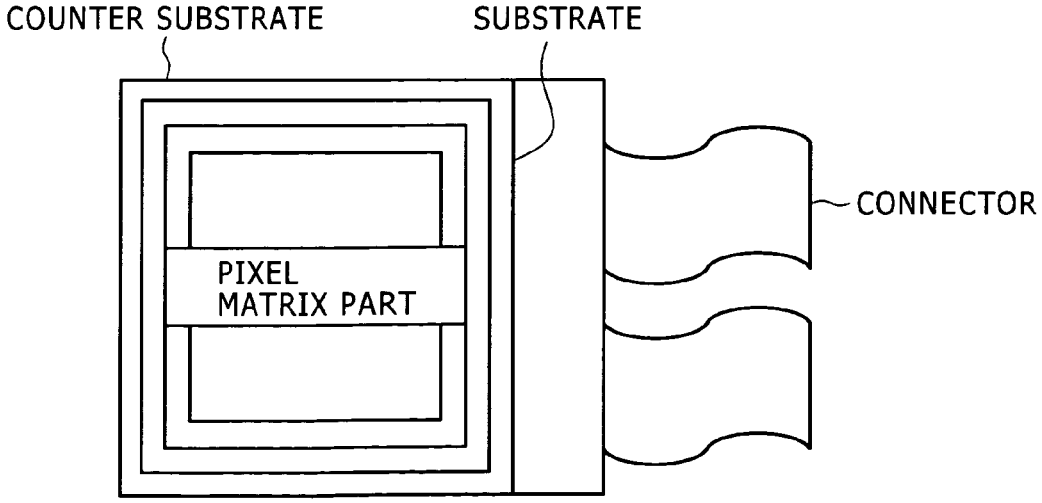
FIG. 13 is a plan view of assistance in explaining a module configuration of a display device according to an embodiment of the present invention.

A display device according to an embodiment of the present invention includes a display device of a flat module shape as shown in FIG. 13. For example, a pixel array unit in which pixels each including an organic EL element, a thin film transistor, a thin film capacitance and the like are integrated and formed in the form of a matrix is disposed on an insulative substrate. An adhesive is disposed in such a manner as to surround the pixel array unit (pixel matrix part), and a counter substrate such as a glass or the like is attached to form a display module. The transparent counter substrate may be provided with color filters, a protective film, a light shielding film and the like as demanded. The display module may be provided with a FPC (Flexible Printed Circuit), for example, as a connector for externally inputting or outputting a signal and the like into the pixel array unit.

The display devices according to the above-described embodiments of the present invention have a flat panel shape, and are applicable to displays of various electronic devices in every field that displays a driving signal input to the electronic devices or generated within the electronic devices as an image or video, the electronic devices including a digital camera, a laptop personal computer, a portable telephone, and a video camera. An example of electronic devices to which such a display device is applied will be illustrated in the following.

Figure 14:
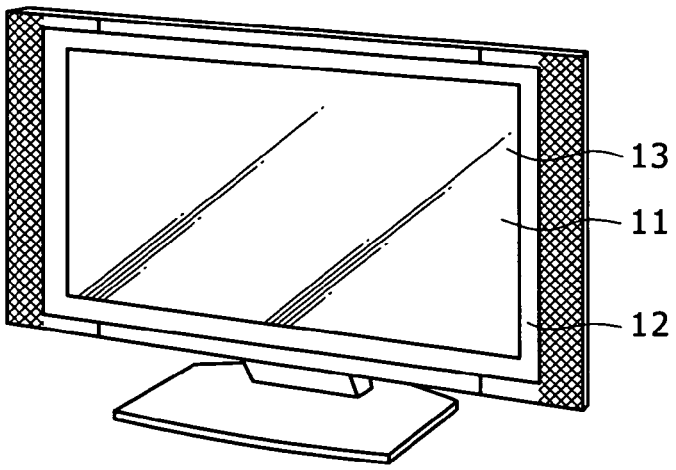
FIG. 14 is a perspective view of a television set including a display device according to an embodiment of the present invention.

FIG. 14 shows a television set to which the present invention is applied. The television set includes a video display screen 11 composed of a front panel 12, a filter glass 13 and the like. The television set is fabricated using a display device according to an embodiment of the present invention as the video display screen 11.

Figure 15:
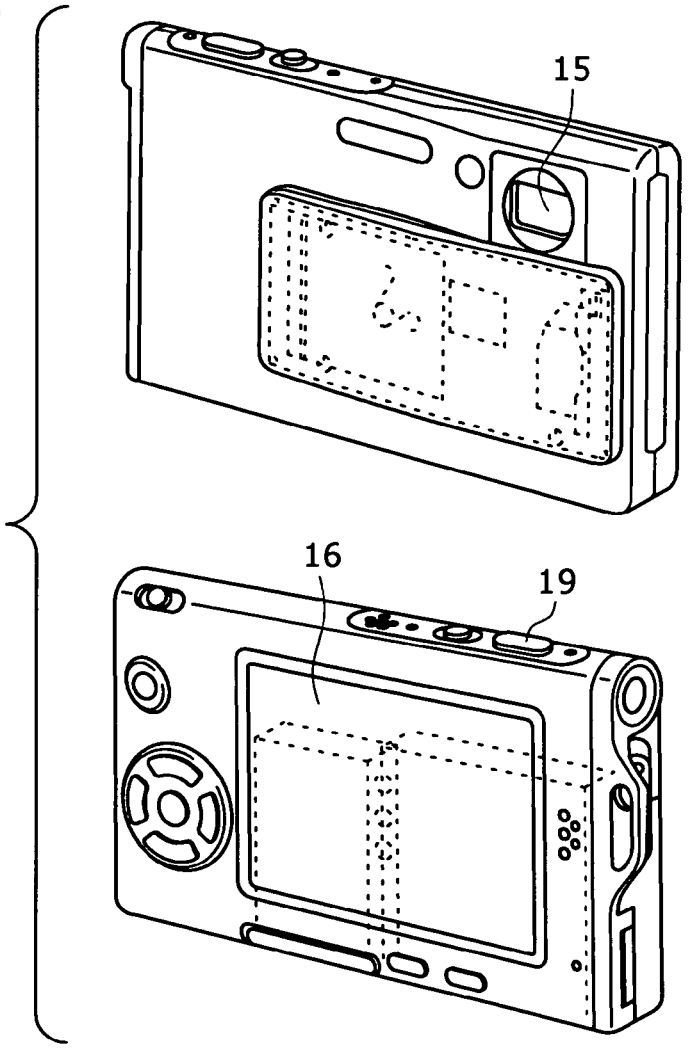
FIG. 15 is a perspective view of a digital still camera including a display device according to an embodiment of the present invention.

FIG. 15 shows a digital camera to which the present invention is applied, an upper part of FIG. 15 being a front view, and a lower part of FIG. 15 being a rear view. The digital camera includes an image pickup lens, a light emitting unit 15 for flashlight, a display unit 16, a control switch, a menu switch and a shutter 19. The digital camera is fabricated using a display device according to an embodiment of the present invention as the display unit 16.

Figure 16:
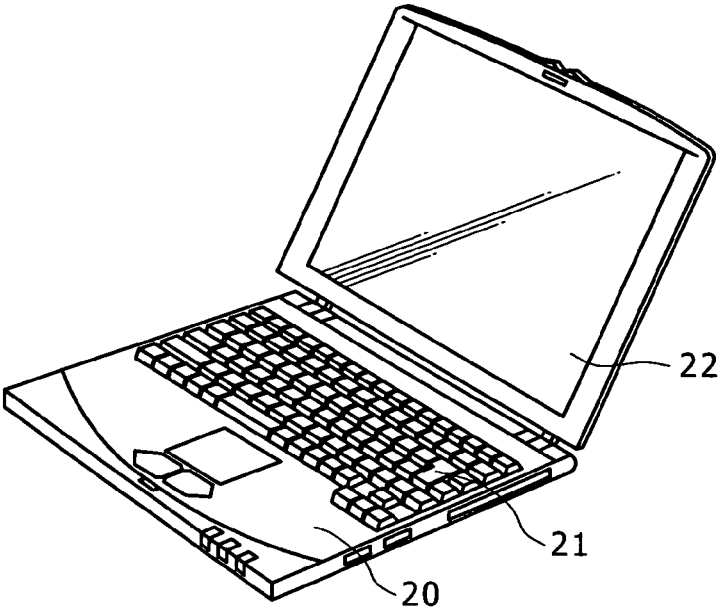
FIG. 16 is a perspective view of a laptop personal computer including a display device according to an embodiment of the present invention.

FIG. 16 shows a laptop personal computer to which the present invention is applied. A main unit 20 of the laptop personal computer includes a keyboard 21 operated to input characters and the like, and a main unit cover of the laptop personal computer includes a display unit 22 for displaying an image. The laptop personal computer is fabricated using a display device according to an embodiment of the present invention as the display unit 22.

Figure 17:
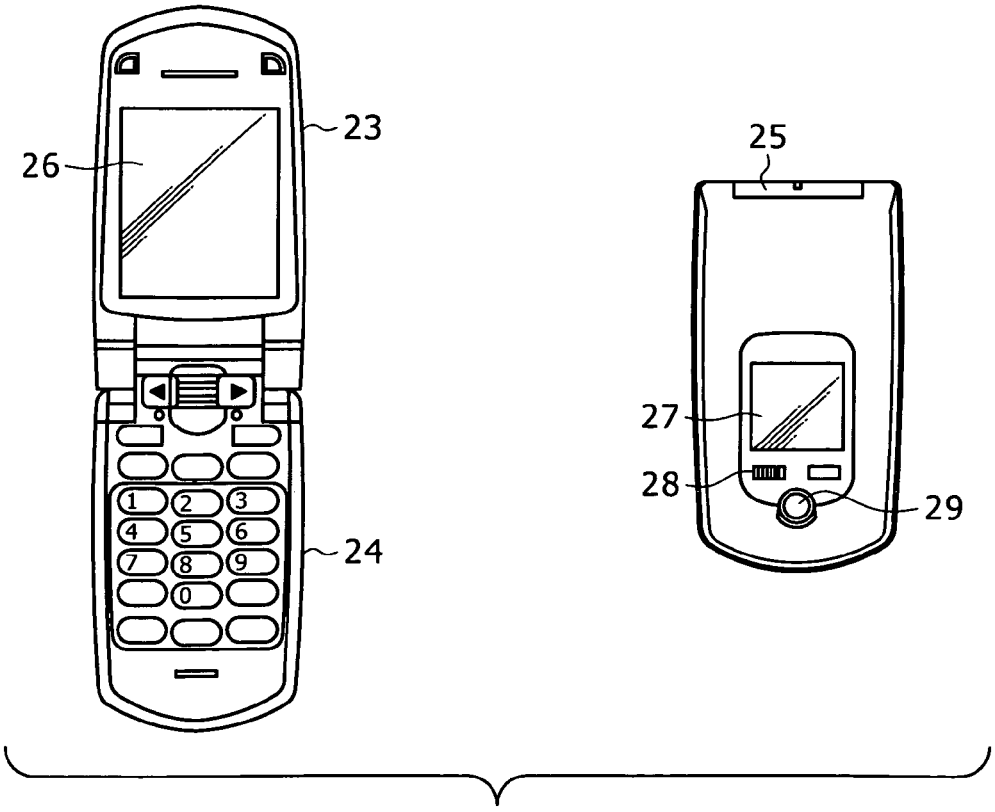
FIG. 17 is a schematic diagram showing a portable terminal device including a display device according to an embodiment of the present invention.

FIG. 17 shows a portable terminal device to which the present invention is applied, a left part of FIG. 17 showing an opened state, and a right part of FIG. 17 showing a closed state. The portable terminal device includes an upper side casing 23, a lower side casing 24, a coupling part (a hinge part in this case) 25, a display 26, a sub-display 27, a picture light 28 and a camera 29. The portable terminal device is fabricated using a display device according to an embodiment of the present invention as the display 26 and the sub-display 27.

Figure 18:
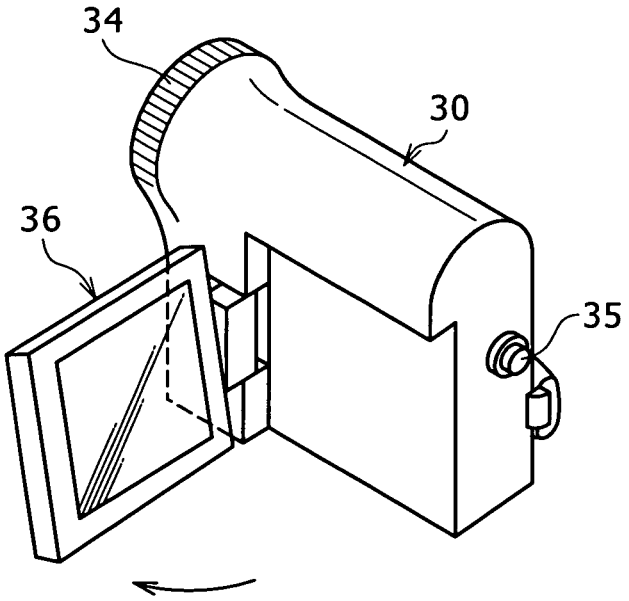
FIG. 18 is a perspective view of a video camera including a display device according to an embodiment of the present invention.

FIG. 18 shows a video camera to which the present embodiment is applied. The video camera includes a main unit 30, a lens 34 for taking a picture of a subject, which lens is situated on a side facing frontward, a start/stop switch 35 at the time of picture taking and a monitor 36. The video camera is fabricated using a display device according to an embodiment of the present invention as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a switching transistor controllable to provide electrical connection and disconnection between an anode of a light emitting element and a terminal of an auxiliary capacitance, said terminal of the auxiliary capacitance being directly electrically connected to a terminal of a retaining capacitance and being directly electrically connected to a drain terminal of the switching transistor;

a drive transistor controllable to provide electrical connection and disconnection between said drain terminal of the switching transistor and a power supply line, said power supply line being directly electrically connected to a different terminal of the auxiliary capacitance and being directly electrically connected to a drain terminal of the drive transistor;

a sampling transistor controllable to provide electrical connection and disconnection between a signal line and a gate terminal of the drive transistor, said gate terminal of the drive transistor being directly electrically connected to a different terminal of the retaining capacitance and being directly electrically connected to a drain terminal of the sampling transistor; and a source terminal of the drive transistor directly electrically connected to said drain terminal of the switching transistor and directly electrically connected to said terminal of the auxiliary capacitance.

2. The display device according to claim 1, wherein a drive scanner is directly electrically connected to a gate terminal of the switching transistor.

3. The display device according to claim 2, wherein a drive control signal output from said drive scanner controls said switching transistor to electrically connect said drain terminal of the switching transistor to said power supply line.

4. The display device according to claim 3, wherein a drive control signal output from said drive scanner controls said switching transistor to electrically disconnect said drain terminal of the switching transistor from said power supply line.

5. The display device according to claim 1, wherein a write scanner is directly electrically connected to a gate terminal of the sampling transistor.

6. The display device according to claim 5, wherein a write control signal output from said write scanner controls said sampling transistor to electrically connect said signal line to said gate terminal of the drive transistor.

7. The display device according to claim 6, wherein a write control signal output from said write scanner controls said sampling transistor to electrically disconnect said signal line from said gate terminal of the drive transistor.

8. The display device according to claim 1, wherein a horizontal selector is configured to output a video signal onto said signal line.

9. The display device according to claim 1, wherein a source terminal of the sampling transistor is directly electrically connected to said signal line.

10. The display device according to claim 1, wherein a drain terminal of the drive transistor is directly electrically connected to said power supply line.

11. The display device according to claim 1, a source terminal of the switching transistor is directly electrically connected to said anode of the light emitting element.

12. The display device according to claim 1, wherein a cathode of the light emitting element is directly electrically connected to a grounding line.

13. The display device according to claim 1, wherein an emission period is a time period when light is emissible from said light emitting element, a non-emission period being a time period when said light is non-emissible from said light emitting element.

14. The display device according to claim 13, wherein said terminal of the auxiliary capacitance is directly electrically connected to said terminal of the retaining capacitance and is directly electrically connected to said drain terminal of the switching transistor during an entirety of said emission period and during an entirety of said non-emission period.

15. The display device according to claim 13, wherein said power supply line is directly electrically connected to said different terminal of the auxiliary capacitance and said drain terminal of the drive transistor during an entirety of said emission period and during an entirety of said non-emission period.

16. The display device according to claim 13, wherein said gate terminal of the drive transistor is directly electrically connected to said different terminal of the retaining capacitance and is directly electrically connected to said drain terminal of the sampling transistor during an entirety of said emission period and during an entirety of said non-emission period.

* * * * *